United States Patent [19]

Kwasnik et al.

[11] 4,407,702

[45] Oct. 4, 1983

[54] APPARATUS TO EXTRACT GASES EVOLVING DURING CHARGING OF A COKE OVEN

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 451,456

[22] Filed: Dec. 20, 1982

[30] Foreign Application Priority Data

Dec. 21, 1981 [DE] Fed. Rep. of Germany ..... 3150657

[51] Int. Cl.[3] ..... C10B 31/04; C10B 41/00; C10B 45/00

[52] U.S. Cl. ..... 202/263; 202/269

[58] Field of Search ..... 202/242, 248, 263, 269; 414/160

[56] References Cited

U.S. PATENT DOCUMENTS

| | | | |
|---|---|---|---|
| 3,821,088 | 6/1974 | Barron | 202/269 |
| 3,957,591 | 5/1976 | Riecker | 202/269 |
| 3,964,977 | 6/1976 | Haase | 202/263 |
| 4,283,253 | 8/1981 | Polenz et al. | 202/263 |
| 4,372,820 | 2/1983 | Naevestad | 202/242 |

FOREIGN PATENT DOCUMENTS 2920406 11/1980 Fed. Rep. of Germany ..... 202/263

*Primary Examiner*—Bradley Garris

*Attorney, Agent, or Firm*—Thomas H. Murray; Clifford A. Poff

[57] ABSTRACT

Disclosed is a tubular device for preventing the egress of gases evolved in an oven chamber during the charging thereof. The tubular device is moved into an operative location forming a hermetic seal with leveling openings in the doors for two adjacent oven chambers, one of which is to receive a coal charge. The gases evolved during the charging operation pass into the adjacent oven chamber where carbonization has proceeded to an advanced state. The tubular device includes two tubular front parts engageable with the leveling openings of coke oven doors, a U-shaped connecting member, and a tubular rear part which is disposed to receive a leveler which can extend through the rear part and into an oven chamber. A flap is raised from a normally-closed position in the rear part of the device by movement of the leveler bar therein. A truck on which the tubular device is mounted can move in a direction of the oven chamber axis on tracks disposed on a frame for the leveler.

8 Claims, 4 Drawing Figures

APPARATUS TO EXTRACT GASES EVOLVING DURING CHARGING OF A COKE OVEN

BACKGROUND OF THE INVENTION

This invention relates to an improved apparatus and arrangement of parts for conducting charging gases evolving in an oven chamber of a coke oven battery into another oven chamber of the battery. More particularly, the present invention relates to such an apparatus to conduct charging gases evolving in an oven chamber in a manner that will reduce or eliminate the environmental nuisance caused by the escape of the charging gases into the atmosphere.

Vibratory charging of coal into a coke oven chamber brings about the development of an environmental nuisance in the form of emission of charging gases from the oven chamber. A popular method of removing such gases is to extract them into a gas main or into a special main under the force of a strong suction. The present invention seeks to overcome disadvantages arising out of the known method of handling charging gases.

SUMMARY OF THE INVENTION

It is an object of the present invention to inhibit the egress of charging gases, particularly in a coke oven battery where a gas main extends along the coke side of the battery by providing a communication between a leveling opening for an oven chamber during the charging operation thereof and a leveling opening for an adjacent oven chamber in which the carbonization process has proceeded to an advanced state.

More particularly, according to the present invention there is provided in a battery of horizontal coke oven chambers, the combination of removable oven doors at the ends of coke oven chambers along one side of the oven battery, the oven doors each having an opening for a leveler for leveling a coal charge in the oven chamber thereof, a gas-conducting means hermetically interconnecting the openings in an oven door of two adjacent oven chambers, truck means including a drive for moving the gas-conducting means in a direction longitudinally of an oven chamber between an operative position forming a hermetic seal with oven chambers and an inoperative position, and a leveler adapted to extend in the gas-conducting means for operation in an oven chamber.

Thus, the present invention provides a tubular device for removing gases evolved during the charging of horizontal coke oven chambers. The tubular device is hermetically engaged with leveling openings in doors for adjacent coke oven chambers to form a gas-conductive interconnection. The tubular device is movable lengthwise of the oven chamber between an operative position and an inoperative position by means of a truck having a drive. A leveler is adapted to extend through the tubular device and disposed on the rear part of the device is a sealable tubular rear part which registers with the path of the leveler so that the leveler can be introduced thereinto and therethrough whereby leveling can be carried out when the tubular device is in an operative position.

The tubular device is preferably comprised of two tubular front parts which are engageable with the openings for the leveler bar in the coke oven doors, an upwardly-extending tubular U-shaped member interconnecting the two tubular front parts, and a tubular rear part disposed in the path of the leveler. A closure flap is arranged for actuation by the leveler, whereby the closure flap is raised as the leveler is passed through the tubular rear part. A truck on which the tubular device is disposed can move on a track disposed laterally of a frame for the leveler.

These features and advantages of the present invention as well as others will be more fully understood when the following description of one embodiment of the apparatus is read in light of the accompanying drawings, in which.

Figure 1:
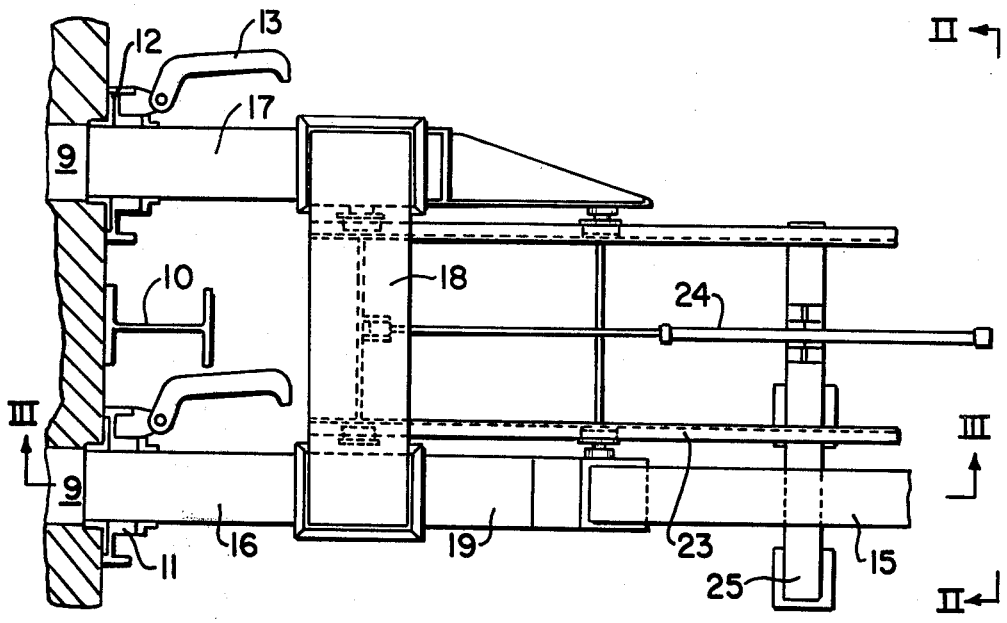
FIG. 1 is a plan view of a tubular device embodying the features of the present invention engaged with doors for two adjacent oven chambers shown in section and forming part of a coke oven battery.
Figure 2:
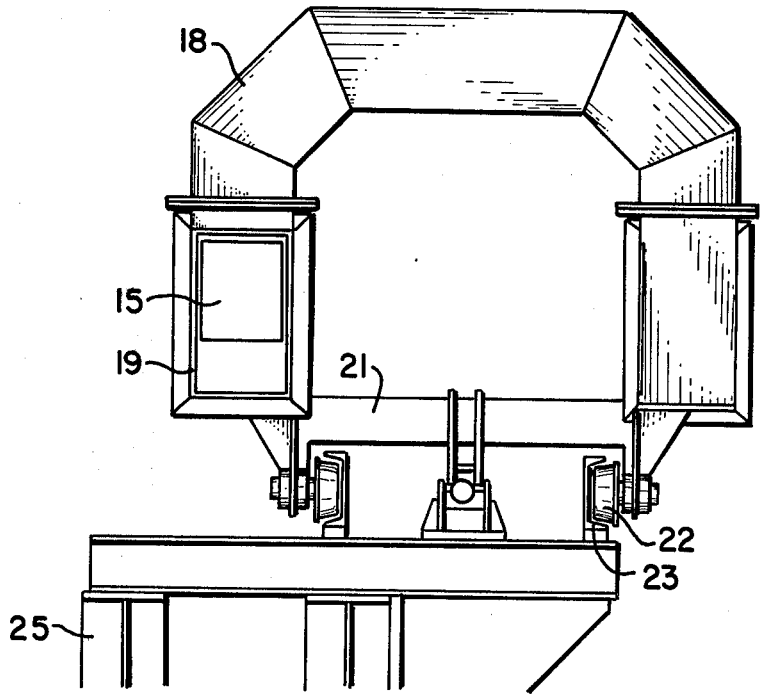
FIG. 2 is an elevational view taken along line II—II of FIG. 1.
Figure 3:
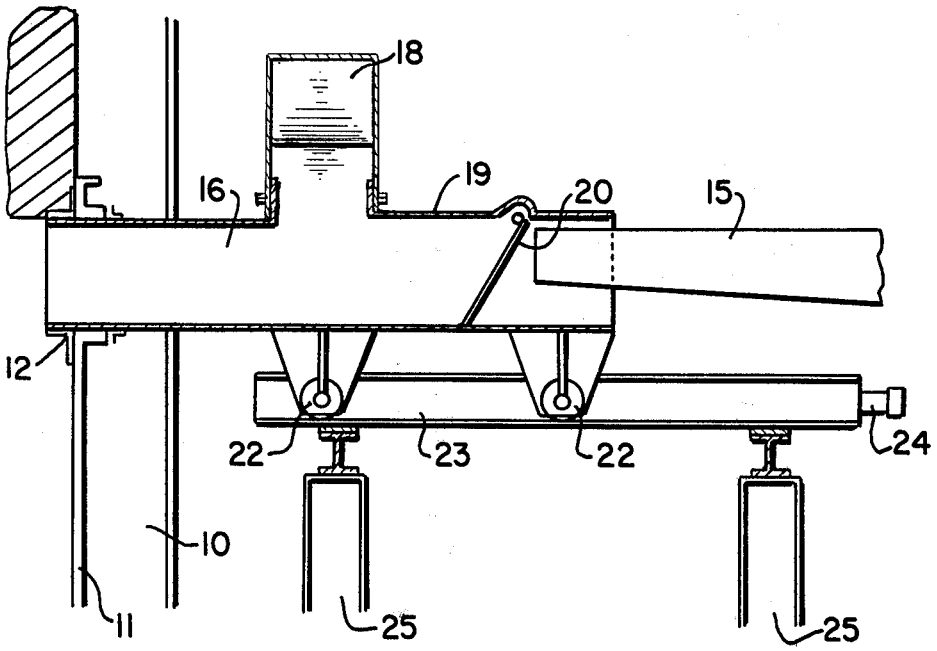
FIG. 3 is a sectional view taken along line III—III of FIG. 1.
Figure 4:
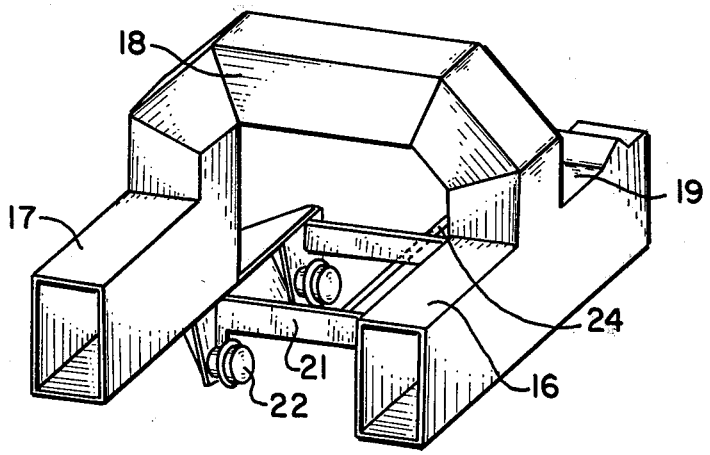
FIG. 4 is an isometric view of the tubular device for conducting charging gases according to the present invention.

Referring to FIG. 1 of the drawings, there is illustrated two horizontal coke oven chambers 9 forming part of a battery of horizontal coke oven chambers that is constructed in any suitable manner, per se, well known in the art. The masonry of the oven chamber is braced by means of buckstays 10. As is conventional, oven doors are used to close the oven chambers at opposite ends thereof. The oven doors for the ends of the oven chambers shown in FIG. 1, e.g., the pusher side, each includes a leveling opening 12 which is closable by pivotal flap 13. Reference numeral 15 identifies a leveler usually in the form of a long bar that is passed into an oven chamber to level a coal charge therein.

The gas-conducting tubular device shown in the drawings according to the present invention includes two tubular front parts 16 and 17 having rectangularly-shaped walls. The front part 16 is engageable with the frame surrounding the leveling opening 12 for a coke oven chamber which is to be charged with coal while front part 17 is engageable with a frame surrounding the leveling opening 12 for a coke oven chamber that is adjacent the oven chamber which is being filled. An upwardly-extending tubular U-shaped member 18 interconnects the front parts 16 and 17. Front part 16 merges into a tubular rear part 19 having rectangularly-shaped walls and normally closed by a pivotally-supported flap 20. The flap is supported on a top wall of rear part 19 so that the flap can be pivoted into a raised position by the leveler 15 as it passes through the rear part 19.

As shown in FIGS. 1–4, the tubular device is disposed on a truck 21 having wheels 22 that can move along a track 23 disposed on a frame 25 of the leveler 15. A drive cylinder 24 is provided to move the tubular device between operative and inoperative locations. Once the door of a coke oven chamber which is to receive a charge of coal has been replaced, the flaps 13 for leveling openings 12 in the door of this oven chamber and of the oven chamber adjacent thereto are pivoted outwardly. The tubular device is then moved forwardly in the direction toward an oven chamber so that the front parts 16 and 17 engage in a sealable manner, preferably hermetically, with the frames that surround the leveling openings in the oven doors. The oven chamber is then charged with coal and as the gases evolve during the charging operation, the gases pass through the tubular device from the oven chamber receiving the coal charge into the oven chamber adjacent thereto. The leveler 15, which is also sometimes called "a leveler bar" is introduced through the tubular rear part 19 and advanced to a point where flap 20 is raised as the leveler moves beyond it. Upon completion of the leveling operation and withdrawal of the leveler from the rear part 19, the tubular device is withdrawn from its operative position to a position remote thereto where it is spaced from the oven chamber. The leveling openings 12 are then closed by movement of the flaps 13.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a battery of horizontal coke oven chambers, the combination of removable oven doors at the ends of the coke oven chambers along one side of the oven battery, said oven doors each having an opening for a leveler for leveling a coal charge in the oven chamber thereof, gas-conducting means hermetically interconnecting said opening in an oven door of two adjacent oven chambers, truck means including a drive for moving said gas-conducting means in a direction longitudinally of an oven chamber between an operative position forming a hermetic seal with oven chambers and an inoperative position, and a leveler adapted to extend in said gas-conducting means for operation in an oven chamber.

2. The combination according to claim 1 wherein said gas-conducting means includes a sealable tubular rear part in the path of said leveler for receiving the leveler for passage into an oven chamber.

3. The combination according to claim 2 wherein said gas-conducting means includes two tubular front parts each engageable with said opening in an oven door, and an upwardly-extending tubular U-shaped member for interconnecting said two tubular front parts in a gas-conducting relation.

4. The combination according to claim 2 further including a closure flap in said sealable tubular rear part for actuation by said leveler.

5. The combination according to claim 1 wherein said gas-conducting means includes two tubular front parts each engageable with said opening in an oven door, an upwardly-extending tubular U-shaped member for interconnecting said two tubular front parts in a gas-conducting relation, and a sealable tubular rear part disposed in the path of said leveler.

6. The combination according to claim 5 further including a closure flap in said sealable tubular rear part for actuation by said leveler.

7. The combination according to claim 6 further including a leveler frame for supporting said leveler, and a track disposed laterally of said leveler frame for carrying said truck means.

8. The combination according to claim 1 further including a leveler frame for supporting said leveler, and a track disposed laterally of said leveler frame for carrying said truck means.

* * * * *